United States Patent [19]

Peschke

[11] 4,295,802

[45] Oct. 20, 1981

[54] VAPOR CONTROL SYSTEM

[75] Inventor: Norman Peschke, Kentwood, Mich.

[73] Assignee: Dover Corporation, Grand Rapids, Mich.

[21] Appl. No.: 53,808

[22] Filed: Jul. 2, 1979

[51] Int. Cl.[3] ..... F04B 17/00

[52] U.S. Cl. ..... 417/405; 141/59; 418/46; 418/255

[58] Field of Search ..... 417/405, 406, 407; 418/46, 60, 212, 213, 200; 141/59, 290, 46, 52

[56] References Cited

U.S. PATENT DOCUMENTS

| | | | |
|---|---|---|---|
| 2,311,162 | 2/1943 | Du Bois | 418/46 |
| 2,489,800 | 11/1949 | Muller | 418/212 |
| 2,567,997 | 9/1951 | Granberg | 417/405 |
| 3,016,928 | 1/1962 | Brandt | 141/59 |
| 3,759,290 | 9/1973 | D'Alba | 417/406 |
| 3,805,208 | 11/1974 | Hamilton | 141/290 |

*Primary Examiner*—Michael Koczo, Jr.

*Attorney, Agent, or Firm*—Blanchard, Flynn, Thiel, Boutell & Tanis

[57] ABSTRACT

Combined vapor pump and a liquid driven motor for driving same. A combined motor and pump, as aforesaid, is provided as a compact unit which is of sufficiently simple design, and possessed of sufficiently few parts, as to be economical in manufacture while being effective in operation and capable of long life with a minimum of maintenance. The unit is made in three basic components, namely a motor component, a pump component and a conduit component positioned between the motor and pump components whereby the manufacture and assembly of said components may be carried out quickly and efficiently and whereby, further, a malfunctioning unit can be quickly and easily repaired by replacing in a simple manner the malfunctioning component thereof. Means comprising a chamfer in the body structure adjacent the vanes of the motor are provided to minimize the deleterious effect of dirt or grit entering into the motor from the liquid used for driving same.

7 Claims, 11 Drawing Figures

VAPOR CONTROL SYSTEM

FIELD OF THE INVENTION

The invention relates to combined motor-pump apparatus and particularly to a type thereof in which the motor is adapted to be driven by a liquid such as gasoline and the pump is adapted for the pumping of a vapor such as a gasoline vapor, the whole being manufacturable in three separate components adapted for manufacture and assembly in a simple manner and capable of long operation with a minimum of maintenance.

BACKGROUND OF THE INVENTION

In the dispensing of a volatile hydrocarbon fuel, such as gasoline, primarily the dispensing of same into fuel tanks of motor vehicles including aircraft, there is and has been a need for capturing and handling the vapor escaping from the filler spout of the motor vehicle fuel tank during the filling operation. While it is simple enough to provide a shroud over or adjacent the said spout, presently known vapor pumps and means for driving same have not been entirely satisfactory. Particularly it is desirable that the pump start and stop automatically with the commencement and termination of fuel flow but that same be accomplished with a minimum of special control means and particularly without electrical control means.

Accordingly, the objects of the invention include:

1. To provide a vapor pump and means for driving same which will be of sufficiently simple construction as to be capable of manufacture at low cost, capable of operation over a long period of time with a minimum of maintenance and which if maintenance is required, same can be provided quickly, easily and economically.
2. To provide a pump and motor assembly, as aforesaid, in which the pump can be manufactured in one unit and the motor in another unit; and a third unit providing for both external connections and passageways between the pump and motor units may also be provided in a simple manner.
3. To provide a pump and motor unit, as aforesaid, in which said three components are easily manufactured separately from each other and then can be rapidly and economically assembled or in the event of malfunctioning of any one component, same can be quickly and easily replaced.
4. To provide a pump and motor, as aforesaid, wherein means are provided in the motor to minimize the deleterious effects of any grit or dirt appearing in the driving liquid.
5. To provide a pump and motor assembly, as aforesaid, in which the motor is driven by the flow of a liquid fuel from source means to the fuel tank being filled whereby the starting and stopping of the vapor pump will coincide with starting and stopping of the flow of such fuel without external or other controls being required.

Other objects and purposes of the invention will be apparent to persons acquainted with apparatus of this general type upon reading the following disclosure and inspection of the accompanying drawings.

DETAILED DESCRIPTION

Figure 1:
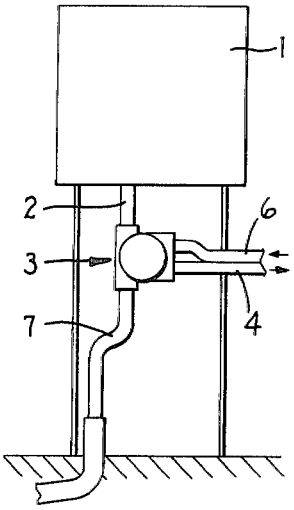
FIG. 1 is a schematic drawing indicating the normal use of an apparatus of the invention.

In considering the environment within which the present invention is designed to be used, attention is first directed to FIG. 1 wherein the numeral "1" indicates a source of a volatile fuel, which may hereinafter be considered to be gasoline, but which in other uses may be diesel fuel, kerosene, alcohol, other forms of liquid fuels or other liquids. The discharge conduit 2 connects said source 1 to the motor-pump unit 3 comprising the invention and the conduit 4 indicates the hose leading to the fuel tank of the automobile or other vehicle, including aircraft, whose fuel tank or tanks is or are to be filled. A return line 6, which may if preferred be concentric with the line 4 over at least much of its length, is provided for returning collected vapor from adjacent said fuel tank or tanks to the motor-pump unit 3. A line 7 conducts the vapor exiting from the pump portion of the motor-pump unit 3 and conducts it to suitable recovery, disposal or other handling means.

Figure 2:
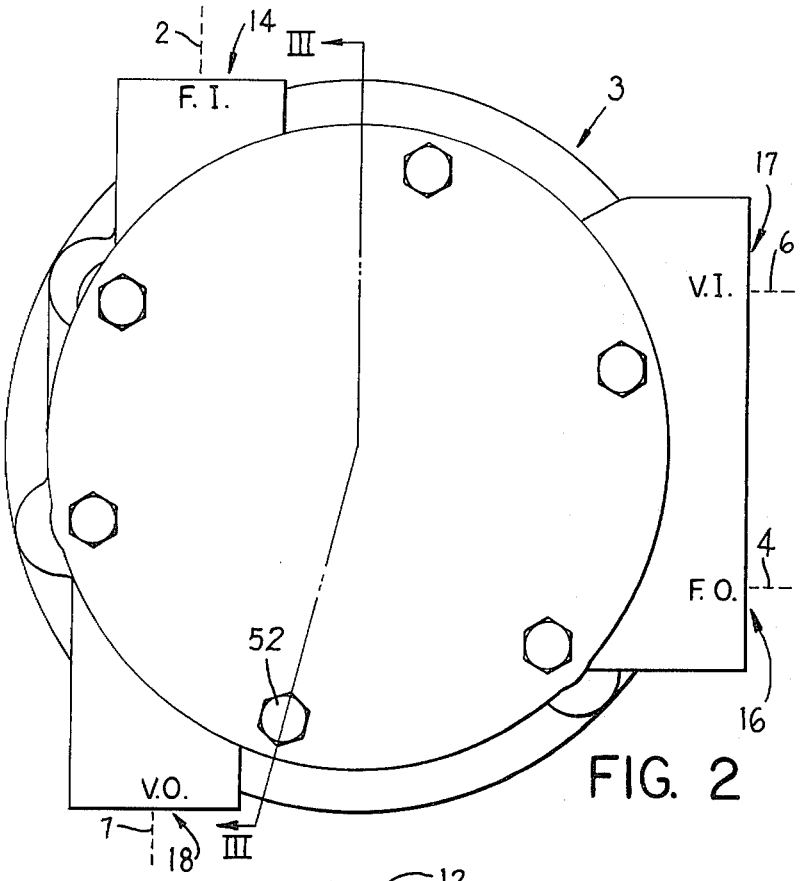
FIG. 2 is a side elevation of a unit comprising the invention.
Figure 3:
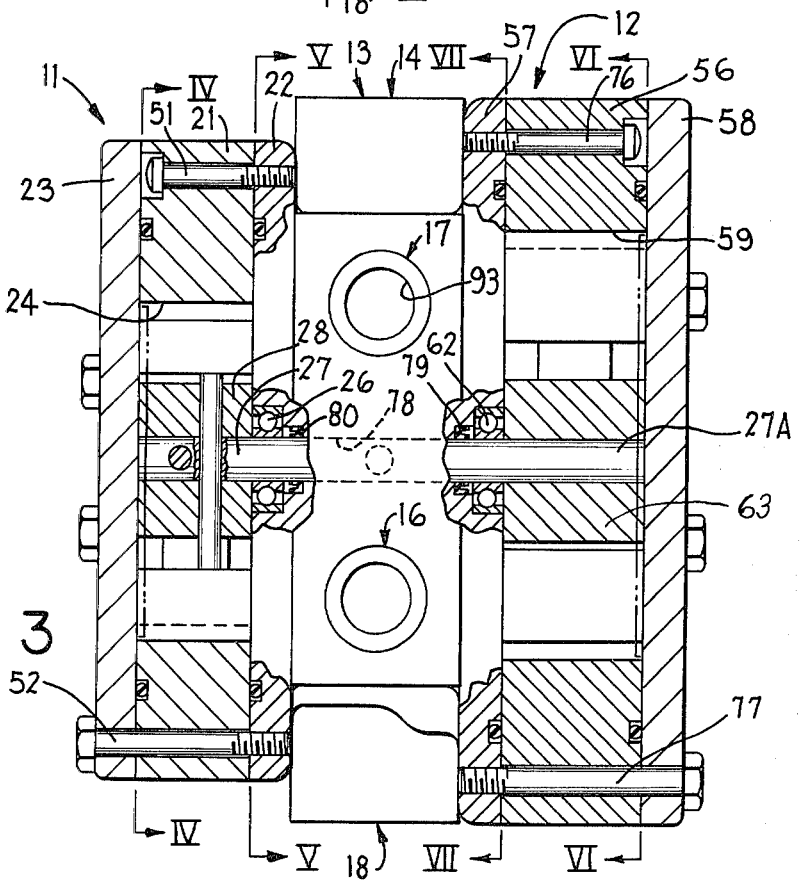
FIG. 3 is a partially sectional view, the sectional portion thereof being taken on the line III—III of FIG. 2.

Turning now to the details of one specific motor-pump unit incorporating the invention, same comprises a motor component 11, a pump component 12 and a connection and passageway component 13. As best shown in FIG. 3, the connection and passageway component is positioned between the motor and pump components for convenient communication with each thereof with minimal passageway length. Easy and convenient connections are provided in said connection and passageway component 13 for the connection thereto of the several lines shown in FIG. 1, namely the fuel inlet 14 (FIG. 2) to which is connected the conduit 2, the fuel outlet 16 to which is connected the conduit 4, the vapor inlet 17 to which is connected the conduit 6 and the vapor outlet 18 to which is connected the conduit 7.

Turning now for a more detailed consideration of the structure of the particular apparatus here shown for illustrative purposes, attention is directed to the motor unit 11. This comprises a body section 21 having various openings therein, hereinafter further detailed, which body member is closed on its one side by a first motor end plate 22 and on its other side by a second motor end plate 23. In this instance the first end plate 22 is integral with, and comprises a portion of, the connection and passageway component 13 but it may be a separate plate if desired and for convenience in description it will hereinafter be referred to as an independent element.

Figure 4:
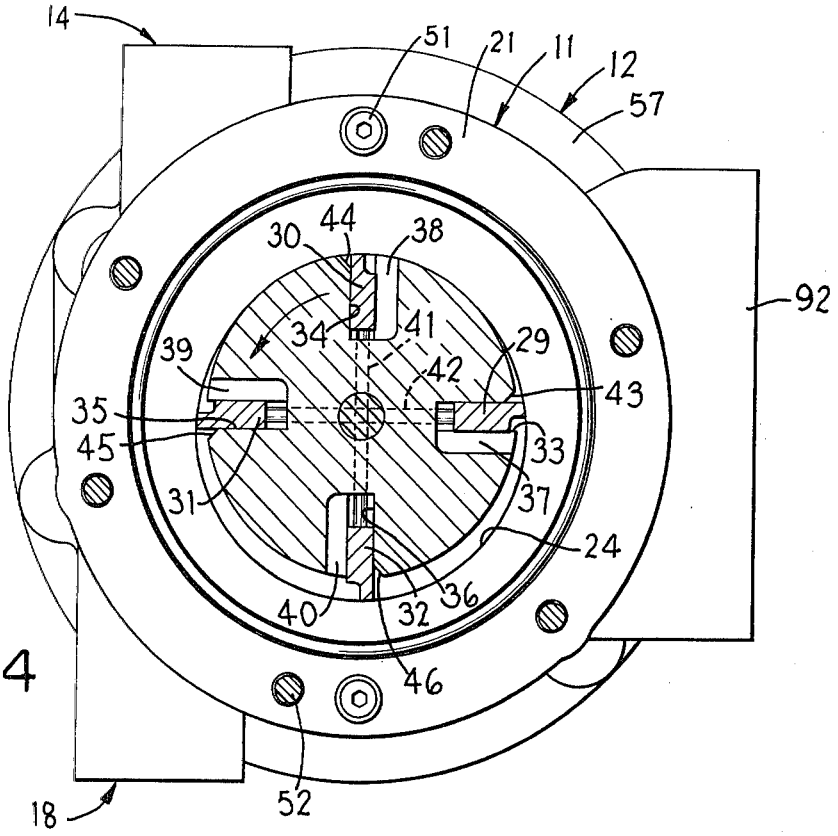
FIG. 4 is a sectional view taken on the line IV—IV of FIG. 3.

Considering first the body section 21, same has, as best shown in FIG. 4, a central opening 24 therein which defines an elliptical cavity in a manner conventional for vane pumps. At the center of curvature for one end of said cavity, there is mounted, as by the bearing 26 (FIG. 3) in the first plate 22, a rotatable shaft 27 supporting a rotor 28 and carrying reciprocal vanes 29–32 (FIG. 4), reciprocable in radially aligned slots 33–36, respectively, and provided in a likewise known manner with pressure counterbalancing openings 37–40, respectively. Each of said openings 37–40 provide communication between the exterior of the rotor 28 and the inner ends of each of the respective vanes to provide pressure balancing for said vanes in a manner already known in the art. Reciprocable pins 41 and 42 are provided between opposite pairs of vanes in a manner already known and for the usual purposes.

Thus far, the motor described is conventional, will be recognized as such by those acquainted with the art and further detailing thereof is unnecessary.

In carrying out one portion of the invention there are also provided at the rotatively leading edges of said slots 33–36, respectively, beveled edges 43–46, respectively. These provide receptacles for such bits of grit, rust flakes, or other foreign material which may be carried by the gasoline passing through such motor and which might otherwise be caused to bear against the vane guiding surface of the central cavity 24 resulting in scratching or abrading of same. Said particles of foreign matter are usually after a few revolutions flushed out of the motor but by providing a receptacle for their reception while they are in such motor, the scratching and consequent leaking of the motor which may otherwise occur is satisfactorily avoided.

Said body section 21 (FIG. 3) is fixed rigidly onto and with respect to the first end plate 22, and thereby to the connection and passageway component 13, by a series of screws of which one appears at 51 and the central cavity 24 of said body section is closed by the second end plate 23 and fixed rigidly with respect thereto by a series of screws of which one appears at 52.

The passageways by which said motor is supplied with motive liquid will be described further hereinafter in connection with a description of the central component 13.

Figure 6:
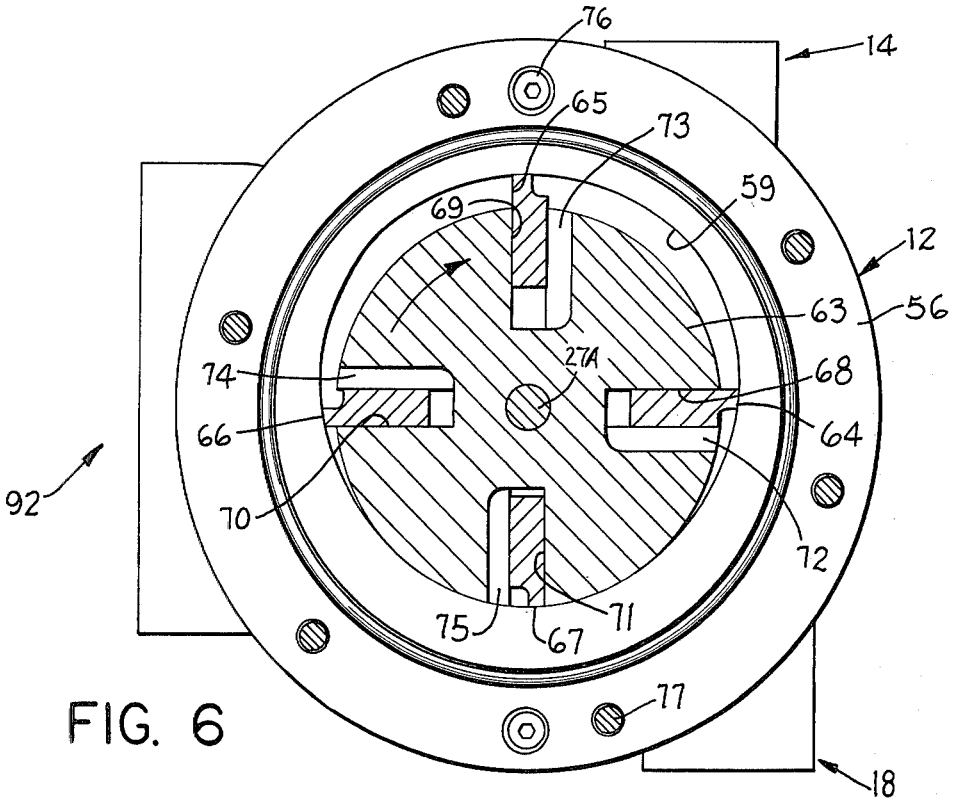
FIG. 6 is a sectional view taken on the line VI—VI of FIG. 3.

Turning now to the pump component 12 (FIG. 6), same may be, and here is, of generally similar construction to that of the motor component 11. Specifically, same comprises a central section 56 with first and second pump end plates 57 and 58 (FIG. 3). The pump end plate 57 (similarly to the motor end plate 22) is in this instance integral with, and comprises a portion of, the connection and passageway component 13 but it may be a separate plate if desired and for convenience in description it will hereinafter be referred to as an independent element. Said central section 56 is provided with a central cavity 59 of elliptical shape and an extension 27A of shaft 27 is rotatably mounted at the center of curvature for at least a portion of said central cavity 59 by any convenient means, as by the bearing 62 positioned in the end plate 57. The rotor 63 (FIG. 6) is mounted on and for rotation with said extension 27A and carries reciprocal vanes 64–67 mounted for radial reciprocation in radial vane slots 68–71, respectively.

Pressure balancing slots 72–75 are provided at each of the vane slots 68–71, respectively, for pressure balancing purposes, the same as in the motor unit 11 in any known manner. Beveled portions (not shown) may if desired be provided at the leading edges of the vane slots 68–71 in the same manner and for the same purposes as the beveled edges 43–46 of the motor component 11.

Said central section 56 is fixed rigidly on and with respect to the first pump end plate 57, and thereby to the connection and passageway component 13, by screws of which one appears at 76. The ports through said plate 57 providing communication with the interior of said pump will be described further hereinafter in connection with a description of the central component 13. The second pump end plate 58 closes the central cavity 59 and is fixed rigidly with respect to said central section 56 in any convenient manner such as by a series of screws of which one appears at 77.

Figure 5:
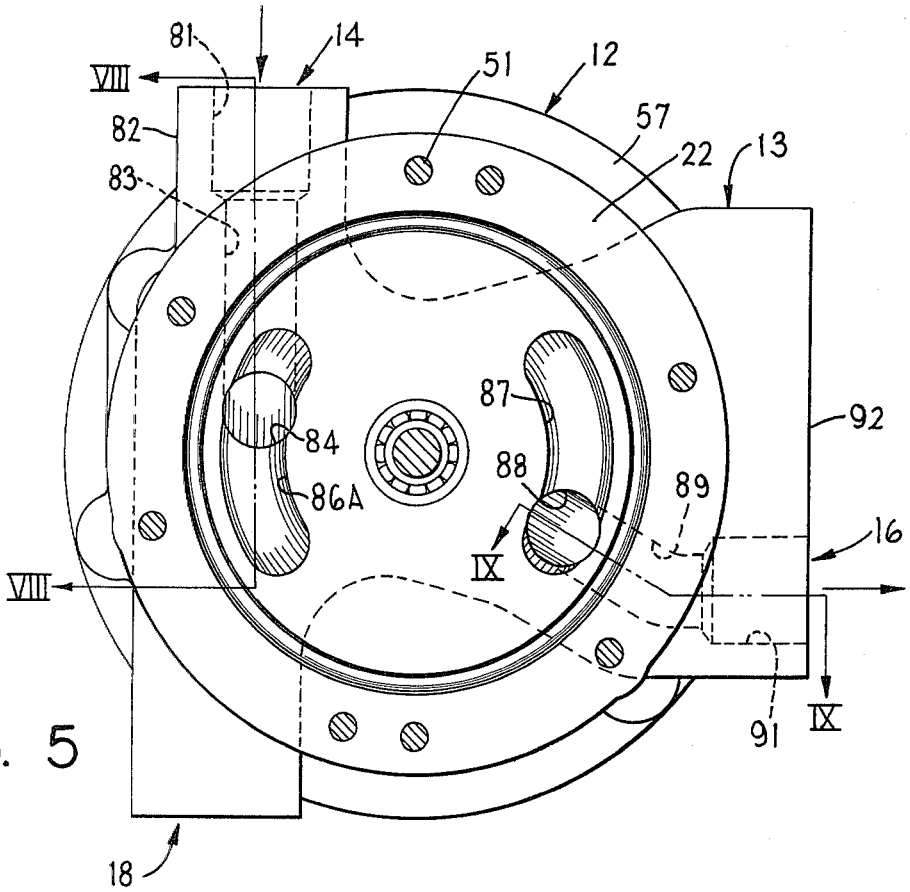
FIG. 5 is a sectional view taken on the line V—V of FIG. 3.
Figure 7:
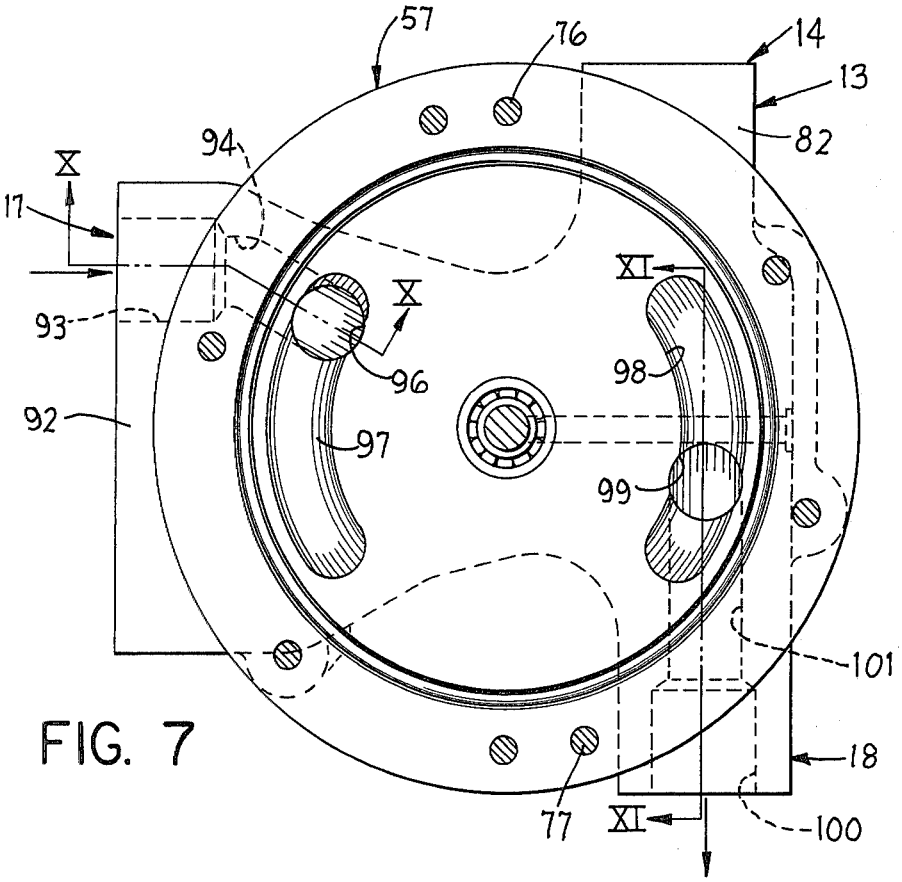
FIG. 7 is a sectional view taken on the line VII—VII of FIG. 3.

Turning now to the central, i.e. the connection and passageway, component 13 (FIGS. 3, 5 and 7), same is of a thickness preferably no greater than that of the motor and pump components 11 and 12, is of an elevational pattern of a somewhat modified T-shape as shown in FIG. 7, and is in this embodiment provided at its ends with the parts above identified as the motor end plate 22 (FIG. 3) and the pump end plate 57. Said central component 13 is provided with an opening 78 therethrough for accommodating the shaft 27, each end of said opening being appropriately sealed by the seals 79 and 80, respectively.

Figure 8:
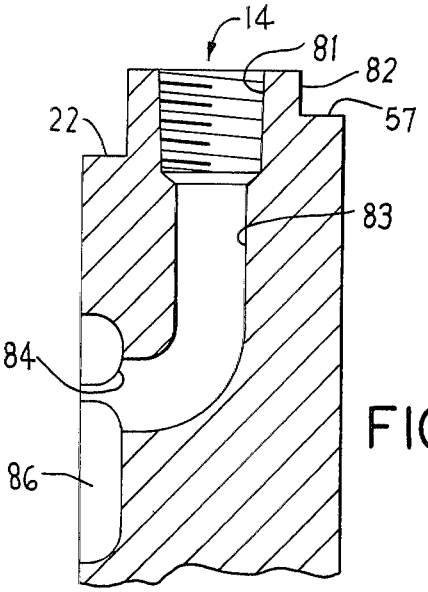
FIG. 8 is a sectional view taken on the line VIII—VIII of FIG. 5.
Figure 9:
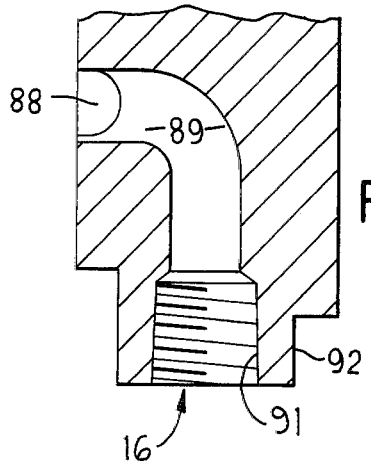
FIG. 9 is a sectional view taken on the line IX—IX of FIG. 5.

Considering first the passageways for the conduction therethrough of motive liquid, such as gasoline being pumped from the reservoir 1, there is provided an opening 81 (FIG. 5) in the end of the projection 82 comprising the fuel inlet 14, which in the orientation of the apparatus shown in the drawings leads first downwardly by the passageway 83 and then flares laterally (see FIG. 8) through the opening 84 and thence through the arcuate slot 86 in the central component 13 and thence through a corresponding arcuate slot 86A (FIG. 5) in the first motor end plate 22 into the suction side of the motor 11, namely the side thereof at which the vanes, here the vane 31, is moving outwardly during the rotative movement of said rotor.

At the opposite side of said rotor, namely where a vane, here the vane 29, is being forced inwardly by the contour of the central opening 24, namely the low pressure side of said motor, there is provided an arcuate slot 87 through the second motor end plate 22 through which exiting pressure liquid passes into the opening 88 and thence via the passageway 89 to the outlet opening 91 in the projection 92 of said central component 13. Pressure liquid thus enters into the central component 13, passes from thence into the motor unit 11, drives said motor and exits therefrom back into the central component 13 and outwardly thereof.

Figure 10:
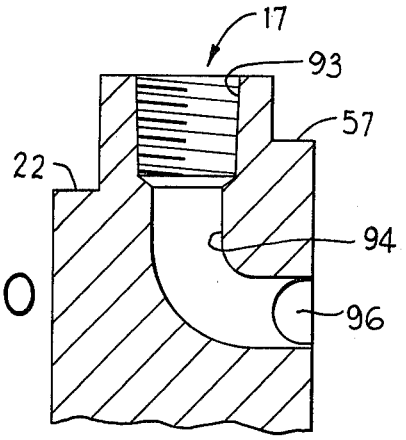
FIG. 10 is a sectional view taken on the line X—X of FIG. 7.
Figure 11:
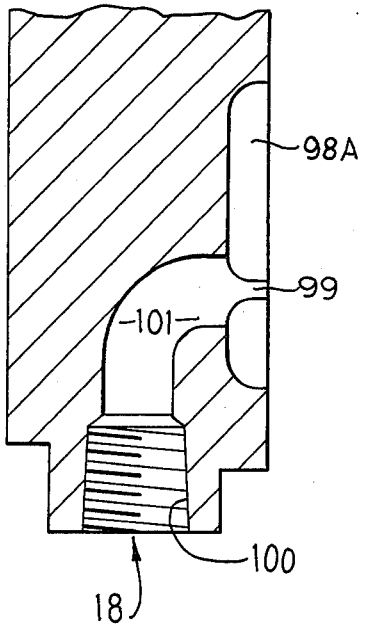
FIG. 11 is a sectional view taken on the line XI—XI of FIG. 7.

Similarly, vapor being pumped enters into said vapor inlet 17 of the central component 13 by way of a suitable opening as the opening 93 in the projection 92 thereof, thence via the passageway 94 (see FIGS. 7 and 10) to a laterally extending opening 96 in said central component and from there by way of the arcuate slot 97 in the first pump end plate 57 into the suction side of the vapor component 12, namely the side thereof where the vanes, here the vane 66, is moving radially outwardly of the rotor 63 as it follows the surface defining the central pump cavity 59. Vapor placed under pressure at the pressure side of said pump, namely the point at which the vanes, here illustrated by the vane 64, is being urged by the wall defining the cavity 59 radially inwardly of the rotor 63, exits through the arcuate slot 98 of the pump end plate 57, thence through a corresponding slot in the central component 13 and into the opening 99 within the central component 13 and thence through the passageway 101 to the opening 100 in the vapor outlet 18 and thence to the conduit 7 and whatever receiving means is provided.

Thus, the central component 13 receives both the driving liquid and the pump vapor, delivers same to the respective motor and pump units, and receives from each thereof the exiting driving liquid and pressurized vapor and delivers each of same to the passageway provided for receiving each thereof. Each of said components will be recognized as capable of ready assembly with or separation from appropriate ones of the other components. The entire apparatus is compact, is simple and is entirely self-contained. Further, the motor unit 11 is immediately and completely responsive to the flow of liquid from the reservoir 1 to appropriate receiving means and the pump is likewise immediately and completely responsive thereto without the need for external controls of any kind whatever.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In an apparatus for withdrawing vapors from the zone adjacent the fill opening of a fuel tank, said apparatus having a motor-pump unit for association with a fuel conducting conduit and a vapor conducting conduit, the improvement comprising:

a central component defining a central housing having first and second enlarged end walls which face in opposite directions and are substantially parallel, said central housing being bounded by peripheral sidewall means;

said central housing having a fuel inlet port connectible to the fuel conduit and communicating with a first fuel passage which extends interiorly of the central housing and terminates in a first opening formed in said first end wall, and a fuel discharge port connectible to the fuel conduit and communicating with a second fuel passage which extends interiorly of said central housing and terminates in a second opening formed in said first end wall;

said central housing also including a vapor inlet port connectible to the vapor conduit and communicating with a first vapor passage which extends interiorly of said central housing and terminates in a third opening formed in said second end wall, and a vapor discharge port connectible to the vapor conduit and communicating with a second vapor passage which extends interiorly of said central housing and terminates in a fourth opening formed in said second end wall;

elongate shaft means rotatably supported on said central housing so that the rotational axis of said shaft means is substantially perpendicular to said first and second end walls, said shaft means having first and second end portions which respectively project outwardly beyond said first and second end walls;

a motor component connectible into the fuel-flow path for rotating or stopping as the fuel flows or stops flowing, respectively;

said motor component including a motor housing removably but fixedly attached to said central housing directly adjacent said first end wall, said motor housing having an elliptical central cavity, and a vane-carrying rotor rotatably mounted within said cavity and nonrotatably secured to the first end portion of said shaft means, said first and second openings respectively communicating with high and low pressure zones of said cavity adjacent said rotor;

a pump component drivingly connected for rotation with said motor component and introducible into the vapor flow path for creating a vapor withdrawing suction in said vapor conduit simultaneous with the flow of fuel in the fuel conduit;

said pump component comprising a pump housing removably and fixedly secured to said central housing adjacent said second end wall, said pump housing defining an elliptical central cavity, and a vane-carrying rotor rotatably mounted within said cavity, and nonrotatably secured to the second end portion of said shaft means, said third and fourth openings respectively communicating with low and high pressure zones within said pump cavity.

2. An apparatus according to claim 1, wherein said motor housing includes an annular body portion defining therein the motor cavity, said body portion having one end thereof in abutting engagement with said first end wall so that the latter effectively closes one axial end of said cavity, said motor housing also including an exterior end wall overlying the other end of said annular body portion for closing the other axial end of said motor cavity, said exterior end wall and said annular body portion being fixedly but removably attached to said central housing;

said pump housing including an annular body portion having one end thereof in abutting engagement with said second end wall so that the latter effectively closes one axial end of said pump cavity, said pump housing also including an exterior end wall which overlies the other end of said annular body portion for closing the other axial end of said pump cavity, said exterior end wall and said annular body portion being fixedly but removably attached to said central housing.

3. An apparatus according to claim 2, including first threaded fastener means associated with each said pump and motor housing solely for fixedly but removably attaching said annular body portion to said central housing, and second threaded fastener means associated with each said motor and pump housing for fixedly but releasably attaching said exterior end wall and its respective annular body portion to said central housing, whereby removal of said second threaded fastener means enables the exterior end wall to be removed to provide access to the respective cavity without disconnecting the respective annular body portion from said central housing.

4. An apparatus according to claim 1, wherein said central housing comprises a platelike member having a minimal thickness as measured perpendicularly between said first and second end walls, and all of said ports opening through the peripheral sidewall means of said central housing.

5. An apparatus according to claim 4, wherein said fuel inlet and fuel outlet ports are respectively aligned in a plane generally perpendicular to said axis of rotation, wherein said vapor inlet and vapor outlet ports are also respectively aligned within said plane, said fuel inlet and outlet ports extending substantially at a right angle with respect to one another, said vapor inlet and outlet ports also extending substantially at a right angle with respect to one another, and said fuel inlet and vapor outlet ports being substantially coaxially aligned with one another but opening outwardly from opposite sides of said central housing.

6. An apparatus according to claim 5, wherein said central housing has an approximate T-shaped cross section when viewed in a plane perpendicular to said axis of rotation, the fuel inlet and vapor outlet ports being formed at opposite ends of the head of the T-shaped cross section, and the vapor inlet and fuel outlet ports both opening outwardly from the base of the T-shaped cross section.

7. An apparatus according to any one of claims 1–4, wherein each of said first through fourth openings comprises an elongated arcuate slot generated about said axis of rotation.

* * * * *